US010545004B1

(12) United States Patent
Forbes

(10) Patent No.: US 10,545,004 B1
(45) Date of Patent: Jan. 28, 2020

(54) BULLET CASING CAPTURING ASSEMBLY

(71) Applicant: Rodney Forbes, Amarillo, TX (US)

(72) Inventor: Rodney Forbes, Amarillo, TX (US)

( * ) Notice: Subject to any disclaimer, the term of this patent is extended or adjusted under 35 U.S.C. 154(b) by 0 days.

(21) Appl. No.: 16/248,962

(22) Filed: Jan. 16, 2019

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 42/98
See application file for complete search history.

(56) References Cited

U.S. PATENT DOCUMENTS 663,262 A * 12/1900 Dieterich ..... F41A 9/60 224/0.5
1,027,509 A * 5/1912 Smiley ..... F41A 9/60 42/106
1,201,189 A * 10/1916 Johnson ..... F41A 9/60 224/0.5
1,304,468 A * 5/1919 Fernandez ..... F41A 9/60 224/0.5
1,614,755 A * 1/1927 Neef ..... F41A 35/02 42/70.11
2,354,277 A * 7/1944 Richardson ..... F41A 9/60 42/98
2,421,858 A * 6/1947 Trimbach ..... F41A 9/60 89/34
3,153,981 A * 10/1964 Brass ..... F41A 9/60 42/98
3,156,991 A * 11/1964 Adams ..... F41A 9/60 42/98
3,609,900 A * 10/1971 Bernocco, Jr. ..... F41A 9/60 42/98
3,739,685 A * 6/1973 Lundgren ..... F41A 9/60 42/98
3,771,248 A * 11/1973 Linehan ..... F41A 9/60 42/106
3,807,075 A * 4/1974 Mylonas ..... F41A 9/60 42/98
4,020,738 A * 5/1977 Martinez ..... F41A 9/60 42/98
4,028,834 A * 6/1977 Dobson ..... F41A 9/60 42/98
4,110,927 A * 9/1978 Morris ..... F41A 9/60 42/98

(Continued)

FOREIGN PATENT DOCUMENTS

WO WO2015168317 11/2015

OTHER PUBLICATIONS http://akunabrasscatcher.blogspot.com (Year: 2015).*

(Continued)

*Primary Examiner* — Michelle Clement

(57) ABSTRACT

A bullet casing capturing assembly includes a wire that has a sequence of bends thereon to define a handle portion of the wire and a sock portion of the wire. The sock portion is positioned above and is laterally offset with the handle portion. The handle portion engages a handle of a semi-automatic firearm thereby facilitating the sock portion to be aligned with an ejection slot of the semi-automatic firearm. In this way the sock portion is aligned with a trajectory of bullet casings is ejected from the ejection slot. A sock is removably coupled to the sock portion of the wire to capture the bullet casings being ejected from the ejection slot.

6 Claims, 5 Drawing Sheets

(56) References Cited

U.S. PATENT DOCUMENTS 4,166,333 A * 9/1979 Kratzer ..... F41A 9/60 42/98
4,204,353 A * 5/1980 Isola ..... F41A 9/60 42/98
4,334,375 A * 6/1982 Olson ..... F41A 9/60 42/98
4,430,820 A * 2/1984 Marsh ..... F41A 9/60 42/98
4,594,803 A * 6/1986 Muncy ..... F41A 9/60 42/98
4,715,141 A * 12/1987 Kohnke ..... F41A 9/60 42/98
D297,346 S * 8/1988 MacKenzie ..... 42/98
4,903,426 A * 2/1990 Bammate ..... F41A 9/60 42/98
4,959,918 A * 10/1990 Perez ..... F41A 9/60 42/98
5,138,787 A * 8/1992 Riddle ..... F41A 9/60 42/98
5,285,593 A * 2/1994 Bammate ..... F41A 9/60 42/98
5,651,208 A * 7/1997 Benson ..... F41A 9/60 42/106
5,811,716 A * 9/1998 Ellzey ..... F41A 9/60 232/44
5,934,002 A * 8/1999 Blanchet ..... F41A 9/60 42/98
6,173,520 B1 * 1/2001 Bucciarelli ..... F41A 9/60 42/98
6,347,475 B1 * 2/2002 Trostel ..... F41A 9/60 42/98
6,530,169 B1 * 3/2003 Griffin ..... F41A 9/60 42/98
7,168,200 B2 * 1/2007 Perez ..... F41A 9/60 42/98
7,380,364 B1 * 6/2008 Hanson ..... F41A 9/60 42/98
7,536,821 B1 5/2009 Saur
D593,632 S * 6/2009 Oh ..... D22/108
7,798,047 B1 * 9/2010 Moody ..... F41C 27/22 89/33.16
8,091,463 B1 * 1/2012 Moody ..... F41C 27/22 89/33.1
8,291,807 B1 * 10/2012 Moody ..... F41C 27/22 89/33.14
D702,796 S * 4/2014 Healey ..... D22/108
9,360,264 B2 * 6/2016 Rosenthal ..... F41A 9/54
9,366,491 B1 * 6/2016 Baxley ..... F41A 23/16
9,915,486 B1 * 3/2018 Churchill ..... F41A 15/16
9,945,626 B2 * 4/2018 Rosenthal ..... F41A 9/54
10,107,578 B1 * 10/2018 Mirabel ..... F41A 9/60
2002/0007581 A1 * 1/2002 Bucciarelli ..... F41G 1/35 42/98
2006/0101699 A1 * 5/2006 Perez ..... F41A 9/60 42/98
2012/0023803 A1 * 2/2012 Taylor ..... F41A 9/60 42/90
2015/0316338 A1 * 11/2015 Rosenthal ..... F41A 9/60 42/98
2018/0306538 A1 * 10/2018 DiSessa ..... F41A 9/60

OTHER PUBLICATIONS https://www.steyrclub.com/threads/home-made-brass-catcher.2586/ (Year: 2007).*
http://forum.saiga-12.com/index.php?/topic/17681-diy-ghetto-brass-catcher/ (Year: 2007).*
https://rugerforum.net/reloading/94799-brass-catcher.html (Year: 2013).*
https://www.youtube.com/watch?v=9yfkfnjl_l8 (Year: 2015).*
https://www.youtube.com/watch?v=9o4ZewsoyaM (Year: 2016).*
https://www.youtube.com/watch?v=NF6P9PsgT-w (Year: 2013).*

* cited by examiner

BULLET CASING CAPTURING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98

The disclosure and prior art relates to capturing devices and more particularly pertains to a new capturing device for capturing bullet casings ejected from a semi-automatic handgun.

BRIEF SUMMARY OF THE INVENTION

An embodiment of the disclosure meets the needs presented above by generally comprising a wire that has a sequence of bends thereon to define a handle portion of the wire and a sock portion of the wire. The sock portion is positioned above and is laterally offset with the handle portion. The handle portion engages a handle of a semi-automatic firearm thereby facilitating the sock portion to be aligned with an ejection slot of the semi-automatic firearm. In this way the sock portion is aligned with a trajectory of bullet casings is ejected from the ejection slot. A sock is removably coupled to the sock portion of the wire to capture the bullet casings being ejected from the ejection slot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
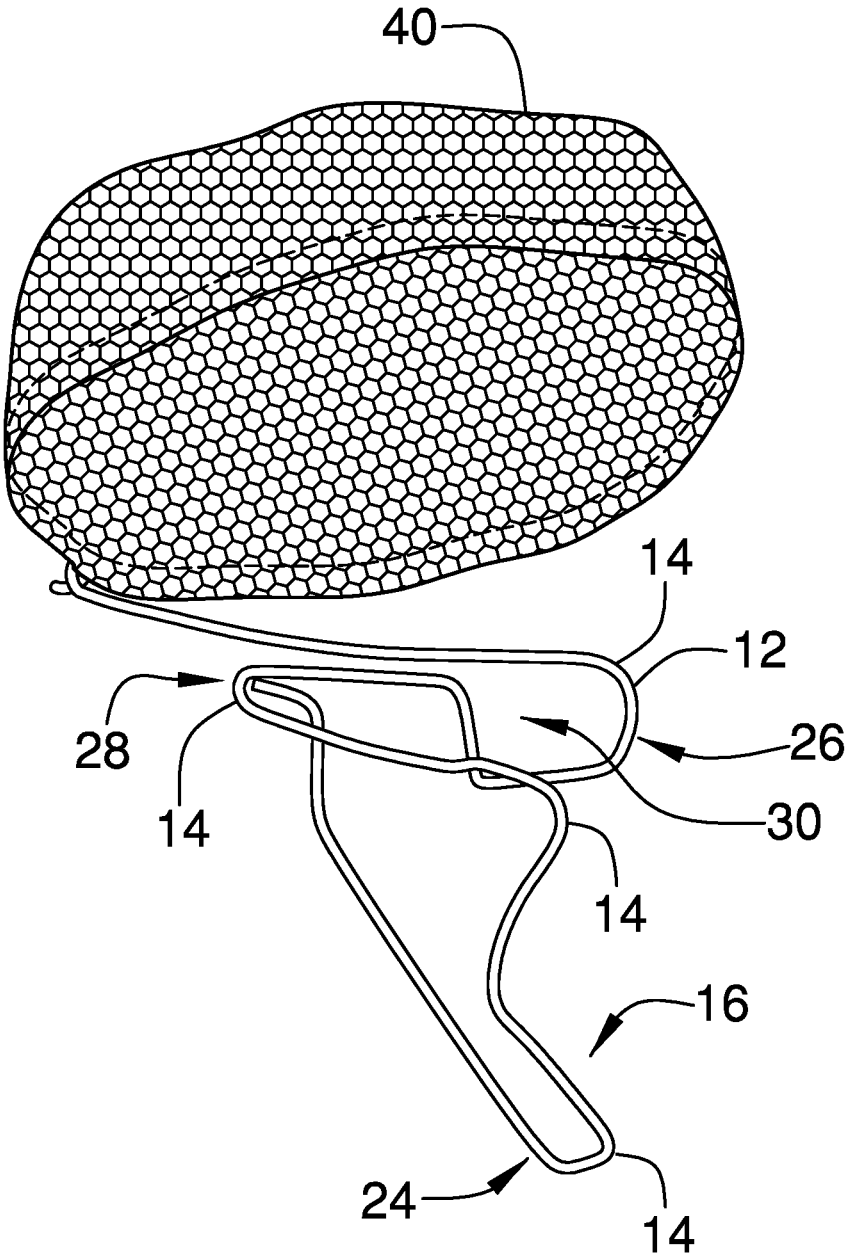
FIG. 1 is a perspective view of a bullet casing capturing assembly according to an embodiment of the disclosure.
Figure 2:
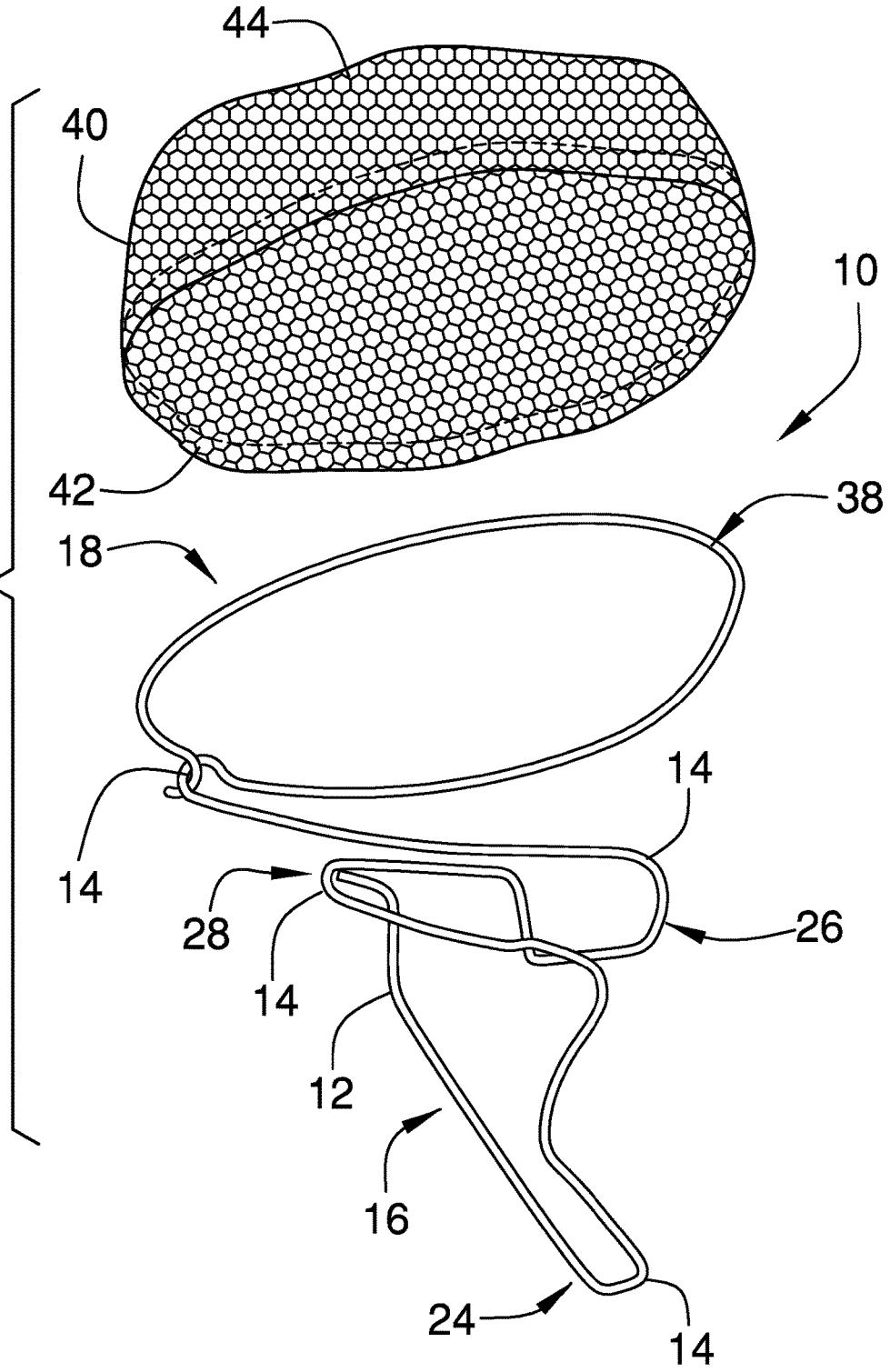
FIG. 2 is an exploded perspective view of an embodiment of the disclosure.
Figure 3:
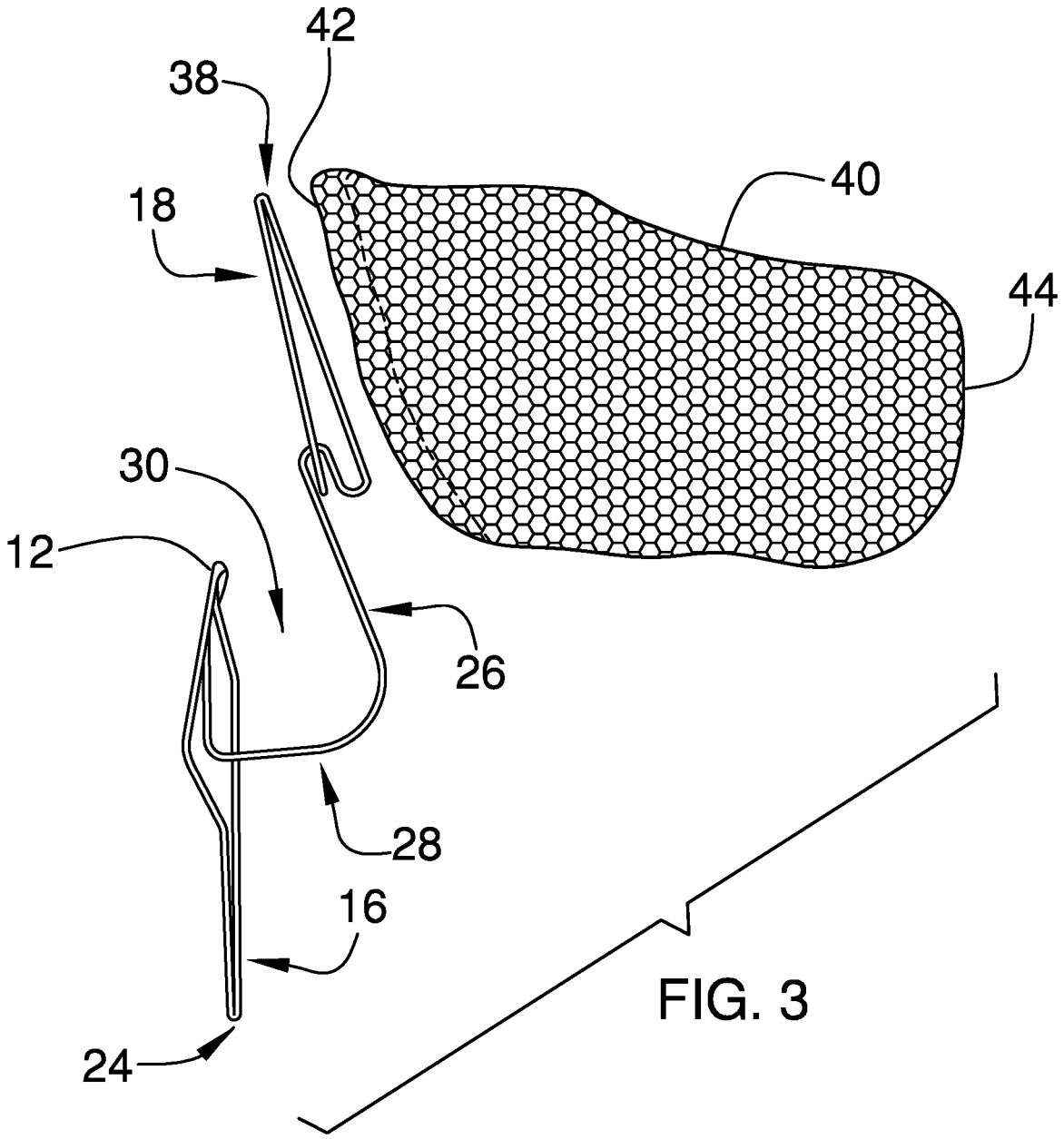
FIG. 3 is a back exploded view of an embodiment of the disclosure.
Figure 4:
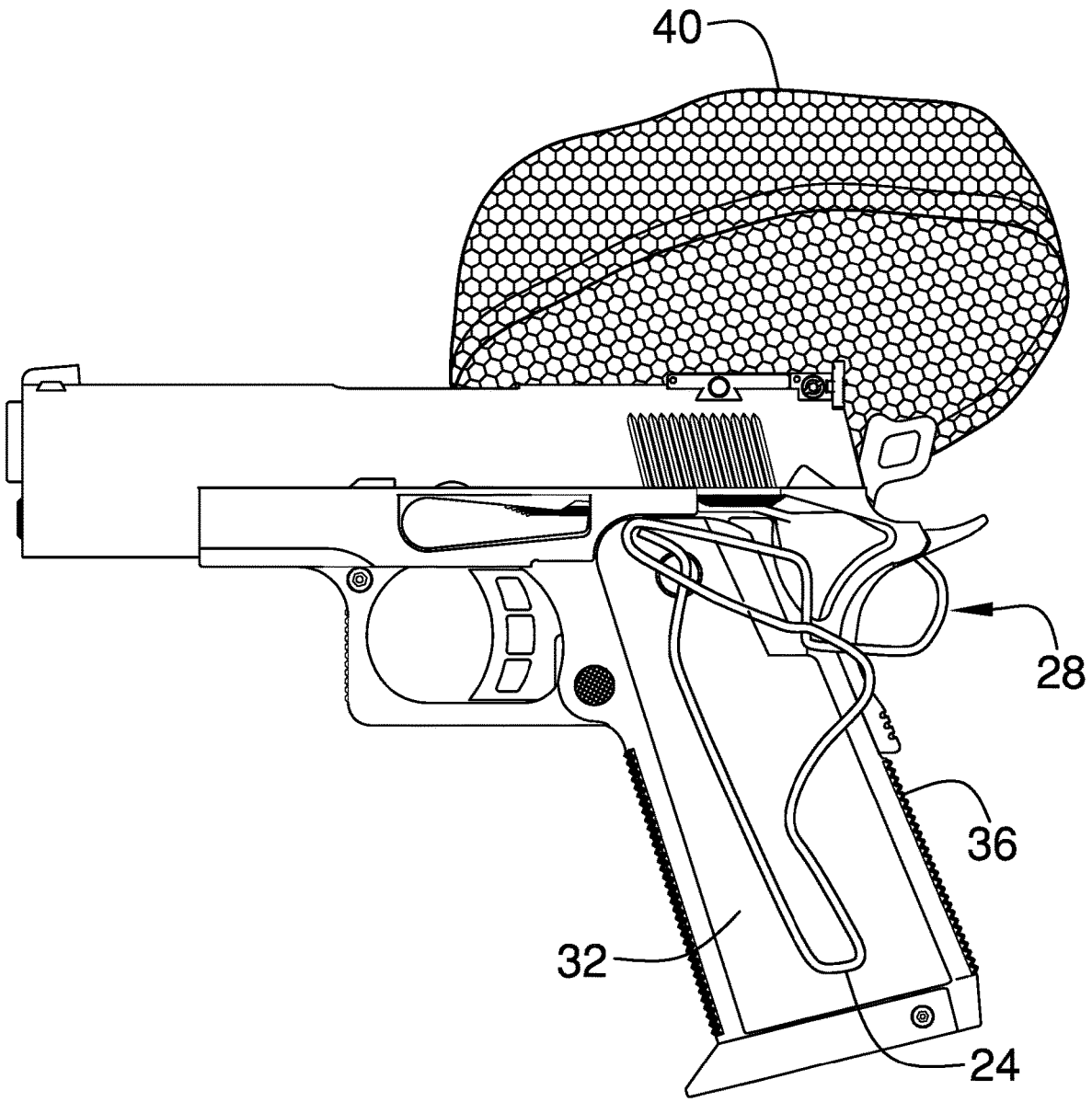
FIG. 4 is a left side in-use view of an embodiment of the disclosure.
Figure 5:
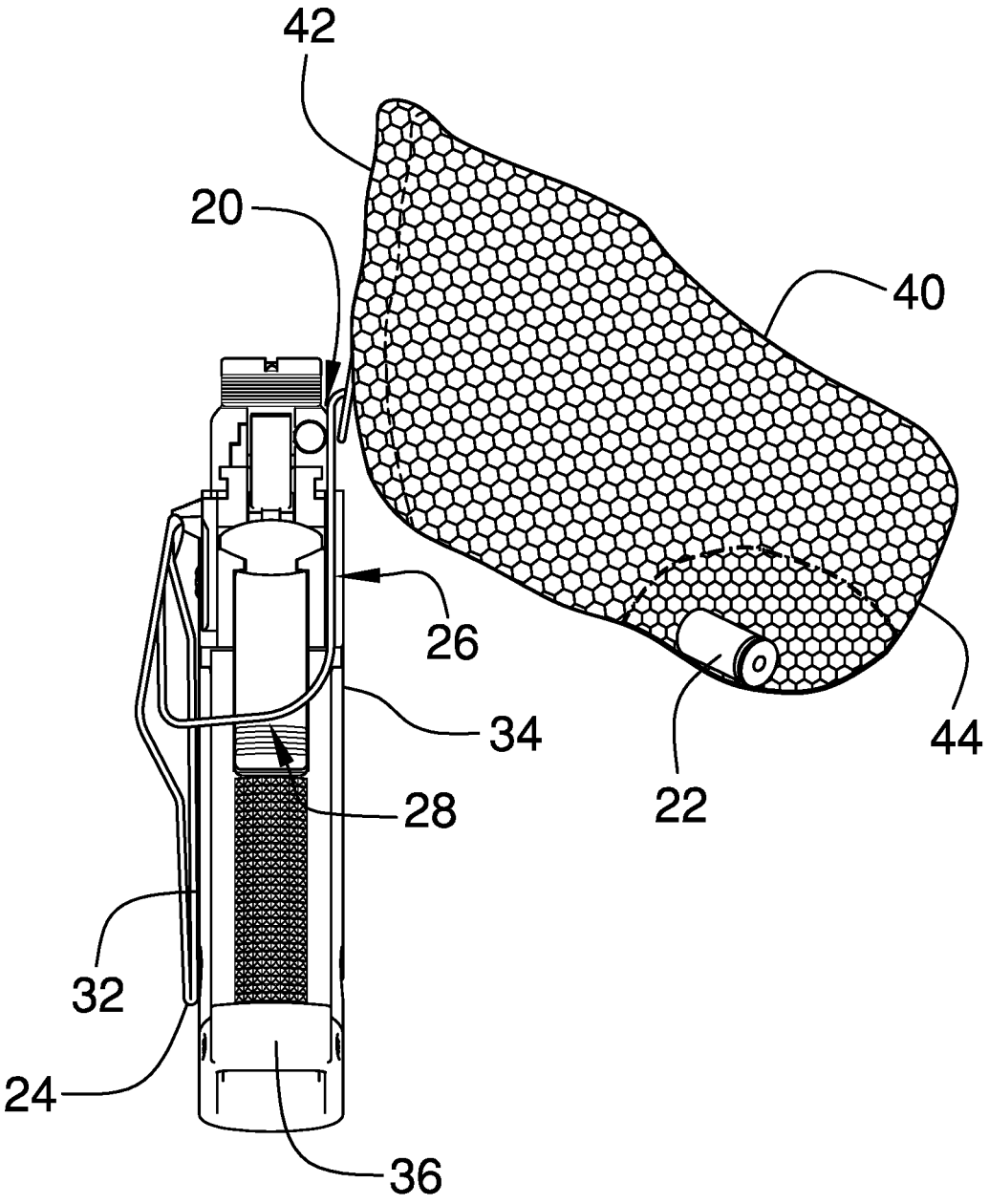
FIG. 5 is a back in-use view of an embodiment of the disclosure.

With reference now to the drawings, and in particular to FIGS. 1 through 5 thereof, a new capturing device embodying the principles and concepts of an embodiment of the disclosure and generally designated by the reference numeral 10 will be described.

As best illustrated in FIGS. 1 through 5, the bullet casing capturing assembly 10 generally comprises a wire 12 that has a sequence of bends 14 thereon to define a handle portion 16 of the wire 12 and a sock portion 18 of the wire 12. The sock portion 18 is positioned above and is laterally offset with the handle portion 16. Moreover, the handle portion 16 engages a handle 17 of a semi-automatic firearm 19 thereby facilitating the sock portion 18 to be aligned with an ejection slot 20 of the semi-automatic firearm 19. In this way the sock portion 18 is aligned with a trajectory of bullet casings 22 is ejected from the ejection slot 20. The semi-automatic firearm 19 may be a striker or hammer fire handgun.

The handle portion 16 comprises a sequence of bends 14 to define a first loop 24, a second loop 26 and a bridge 28 extending between the first 24 and second 26 loops. The first loop 24 is spaced from the second loop 26 thereby defining a handle space 30 between the first 24 and second 26 loops. The first loop 24 extends downwardly from the bridge 28 and the second loop 26 extends forwardly from the bridge 28. The handle 17 of the firearm 19 is positioned in the handle space 30 having the first loop 24 extending downwardly along a first lateral side 32 of the handle 17 and having the second loop 26 extending horizontally along a second lateral side 34 of the handle 17. Additionally, the bridge 28 extends around a back side 36 of the handle 17, typically beneath the hammer or striker.

The sock portion 18 comprises a sequence of bends 14 to define a closed ring 38 that is positioned above the second loop 26. Moreover, the closed ring 38 lies on a plane that is oriented perpendicular to the trajectory of the bullet casings 22 is ejected from the ejection slot 20. Thus, the bullet casings 22 pass through the closed ring 38 when the bullet casings 22 are ejected from the ejection slot 20. The closed ring 38 may have a diameter ranging between approximately 4.0 inches and 6.0 inches. Additionally, each of the handle 16 and sock 40 18 portions are constructed to conform to the dimensions of any existing semi-automatic firearm 19.

A sock 40 is provided and the sock 40 is removably coupled to the sock portion 18 of the wire 12. Thus, the sock 40 can capture the bullet casings 22 being ejected from the ejection slot 20. The sock 40 has a top end 42 and a bottom end 44, and the top end 42 is open for receiving the bullet casings 22. Additionally, the top end 42 is coupled around the closed ring 38 defined by the sock portion 18. The sock 40 may be comprised of a mesh material thereby facilitating the bullet casings 22 to be visible through the sock 40.

In use, the handle portion 16 of the wire 12 is positioned around the handle 17 of the semi-automatic firearm 19 such that the sock portion 18 of the wire 12 is aligned with the ejection slot 20. The sock 40 is positioned around the sock portion 18 of the wire 12 thereby facilitating the sock 40 to capture the bullet casings 22 as they are ejected. Thus, the ejected bullet casings 22 are available for collection for the purposes of reloaded or disposal. In this way an individual that is firing the firearm 19 does not have to manually collect the ejected bullet casings 22. Additionally, the structure of the wire 12 facilitates the handle portion 16 to be removably attached to the firearm 19 without requiring the use of fasteners or otherwise modifying the firearm 19.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bullet casing capturing assembly comprising:

a wire having a sequence of bends thereon to define a handle portion of the wire and a sock portion of the wire, the sock portion being positioned above and being laterally offset with the handle portion, the handle portion being configured for engaging a handle of a semi-automatic firearm thereby facilitating the sock portion to be aligned with an ejection slot of the semi-automatic firearm wherein the sock portion is configured to be aligned with a trajectory of bullet casings being ejected from the ejection slot, the handle portion comprising a sequence of bends to define a first loop, a second loop and a bridge extending between the first and second loops, the first loop being spaced from the second loop thereby defining a handle space between the first and second loop, the first loop extending downwardly from the bridge wherein the first loop is configured to extend along a length of the handle of the semi-automatic firearm whereby the first loop is engaged to the handle of the semi-automatic firearm by a user grasping the handle of the semi-automatic firearm; and a sock being removably coupled to the sock portion of the wire wherein the sock is configured to capture the bullet casings being ejected from the ejection slot.

2. The assembly according to claim 1, wherein the second loop extends forwardly from the bridge, the handle space having the handle of the firearm being positioned therein having the first loop extending downwardly along a first lateral side of the handle and having the second loop extending horizontally along a second lateral side of the handle.

3. The assembly according to claim 2, wherein the sock portion comprises a sequence of bends to define a closed ring being positioned above the second loop, the closed ring lying on a plane being oriented perpendicular to the trajectory of the bullet casings being ejected from the ejection slot wherein the closed ring is configured to have the bullet casing pass therethrough.

4. A bullet casing capturing assembly comprising:

a wire having a sequence of bends thereon to define a handle portion of the wire and a sock portion of the wire, the sock portion being positioned above and being laterally offset with the handle portion, the handle portion being configured for engaging a handle of a semi-automatic firearm thereby facilitating the sock portion to be aligned with an ejection slot of the semi-automatic firearm wherein the sock portion is configured to be aligned with a trajectory of bullet casings being ejected from the ejection slot, the handle portion comprising a sequence of bends to define a first loop, a second loop and a bridge extending between the first and second loops, the first loop being spaced from the second loop thereby defining a handle space between the first and second loop, the first loop extending downwardly from the bridge, the second loop extending forwardly from the bridge, the handle space having the handle of the firearm being positioned therein having the first loop extending downwardly along a first lateral side of the handle whereby the first loop is configured to be secured against the handle of the semi-automatic firearm by a user grasping the handle of the semi-automatic firearm, the second loop extending horizontally along a second lateral side of the handle, the sock portion comprising a sequence of bends to define a closed ring being positioned above the second loop, the closed ring lying on a plane being oriented perpendicular to the trajectory of the bullet casings being ejected from the ejection slot wherein the closed ring is configured to have the bullet casing pass therethrough; and a sock being removably coupled to the sock portion of the wire wherein the sock is configured to capture the bullet casings being ejected from the ejection slot.

5. The assembly according to claim 4, wherein the sock has a top end and a bottom end, the top end being open wherein the top end is configured to have the bullet casings pass therethrough, the top end being coupled around the closed ring defined by the sock portion.

6. A bullet casing capturing assembly comprising:

a wire having a sequence of bends thereon to define a handle portion of the wire and a sock portion of the wire, the sock portion being positioned above and being laterally offset with the handle portion, the handle portion being configured for engaging a handle of a semi-automatic firearm thereby facilitating the sock portion to be aligned with an ejection slot of the semi-automatic firearm wherein the sock portion is configured to be aligned with a trajectory of bullet casings being ejected from the ejection slot, the handle portion comprising a sequence of bends to define a first loop, a second loop and a bridge extending between the first and second loops, the first loop being spaced from the second loop thereby defining a handle space between the first and second loop, the first loop extending downwardly from the bridge, the second loop extending forwardly from the bridge, the handle space having the handle of the firearm being positioned therein having the first loop extending downwardly along a first lateral side of the handle whereby the first loop is configured to be secured against the handle of the semi-automatic firearm by a user grasping the handle of the semi-automatic firearm, the second loop extending horizontally along a second lateral side of the handle, the sock portion comprising a sequence of bends to define a closed ring being positioned above the second loop, the closed ring lying on a plane being oriented perpendicular to the trajectory of the bullet casings being ejected from the ejection slot wherein the closed ring is configured to have the bullet casing pass therethrough; and a sock being removably coupled to the sock portion of the wire wherein the sock is configured to capture the bullet casings being ejected from the ejection slot, the sock having a top end and a bottom end, the top end is open wherein the top end is configured to have the bullet casings pass therethrough, the top end being coupled around the closed ring defined by the sock portion.

* * * * *